US008142238B2

(12) United States Patent
Heigl et al.

(10) Patent No.: US 8,142,238 B2
(45) Date of Patent: Mar. 27, 2012

(54) ELECTRICAL CONNECTOR FOR HIGH TEMPERATURE ENVIRONMENTS

(75) Inventors: Juergen Heigl, Neumarkt-Sankt Veith (DE); Matthias Plischke, Ampfing (DE)

(73) Assignee: Odu Steckverbindungssysteme GmbH & Co. KG, Muehldorf A. Inn (DE)

( * ) Notice: Subject to any disclaimer, the term of this patent is extended or adjusted under 35 U.S.C. 154(b) by 0 days.

(21) Appl. No.: 12/689,242

(22) Filed: Jan. 19, 2010

(65) Prior Publication Data

US 2011/0028051 A1 Feb. 3, 2011

(30) Foreign Application Priority Data

Jan. 20, 2009 (EP) ..... 09150915

(51) Int. Cl.
*H01R 13/187* (2006.01)

(52) U.S. Cl. ..... 439/843; 439/851

(58) Field of Classification Search ..... 439/736, 439/843, 851, 856, 857, 748, 268
See application file for complete search history.

(56) References Cited

U.S. PATENT DOCUMENTS

| | | | | |
|---|---|---|---|---|
| 4,461,531 | A | 7/1984 | Davis et al. | |
| 4,657,335 | A | 4/1987 | Koch et al. | |
| 7,048,596 | B2 * | 5/2006 | Swearingen et al. | 439/843 |
| 7,387,548 | B2 * | 6/2008 | Takehara et al. | 439/843 |
| 2003/0077950 | A1 | 4/2003 | Swearingen et al. | |
| 2007/0123084 | A1 | 5/2007 | Takehara et al. | |

FOREIGN PATENT DOCUMENTS

| | | | |
|---|---|---|---|
| DE | 3528587 | | 2/1987 |
| DE | 198 36 196 | C2 * | 2/1999 |
| DE | 19836196 | | 2/1999 |
| DE | 103 39 958 | A1 * | 4/2005 |
| DE | 10339958 | | 4/2005 |
| EP | 1478055 | | 11/2004 |
| JP | 59-078479 | | 5/1984 |
| JP | 62-271374 | | 11/1987 |
| JP | 04-059086 | | 5/1992 |
| JP | 2001-307809 | | 11/2001 |
| JP | 2007-173198 | | 7/2007 |
| WO | 03044901 | | 5/2003 |
| WO | WO 03/044901 | A1 * | 5/2003 |

OTHER PUBLICATIONS

Search Report of counterpart European patent application EP 09 150 915.8, May 14, 2009.
English translation of the Notice of Reason for Refusal for Japanese Patent Application No. 2010-009817.
English translation of the Notice for Submission of Opinion for Korean Patent Application No. 10-2010-0004443.

* cited by examiner

*Primary Examiner* — Javaid Nasri

(57) ABSTRACT

An electrical connector for establishing an electrical contact with a complementary connector, in particular in a high-temperature environment, the electrical connector including: a housing having an essentially cylindrical inner volume with an opening at least at one end; an elongated contact element disposed inside the inner volume to contact the complementary connector when the latter is introduced into the inner volume; and an elongated spring element disposed between a wall of the inner volume and the contact element to resiliently support the elongated contact element. The contact element includes an anchor section clamped between a first and a second part of the housing.

15 Claims, 5 Drawing Sheets

ELECTRICAL CONNECTOR FOR HIGH TEMPERATURE ENVIRONMENTS

FIELD OF PATENT APPLICATION

The present invention concerns an electrical connector for establishing an electrical contact with a complementary connector, especially in a high-temperature environment.

BACKGROUND

The U.S. Pat. No. 7,387,548 discloses a female electrical connector with an essentially cylindrical electrical contact, the central portion of which is comprises a neck portion to contact a complementary male electrical connector. The electrical contact is a laminate of a member with high electric conductivity, which may be made of copper or a copper alloy, and a spring member made e.g. of stainless steel, phosphor-bronze or beryllium. In one embodiment, the spring member is located on the outside of the electrical contact and the member with high electrical conductivity is located on the inside. End portions of the latter member are folded over the ends of the spring member, to provide portions of the highly electrically conductive member which are pressed against the inner wall of the housing of the electrical connector by means of the spring member in order to provide en electrical contact with the housing.

It can be a disadvantage of this prior art electrical connector that at high temperatures the elasticity of the spring member weakens and no longer presses the highly electrically conductive member against the inner wall of the housing with enough force to provide for a reliable electrical contact.

From the German patent application DE 103 39 958 A1 a wrap connection to connect an electrode wire to an implantable cardiac pacemaker, defibrillator or the like is known. It comprises a tubular contact spring element with multiple longitudinal slits to form longitudinally extending flexible inwardly arched tongues. If an electrode wire plug is introduced into the wrap connection, the tongues are resiliently deflected outwardly to resiliently press against a contact surface of the plug. Moreover, a support spring element of silicone rubber clasps around the spring element to increase the contact pressure between the wrap connection's contact spring element and the plug's contact surface.

A possible disadvantage of this prior art device is that at high temperatures the elasticity of the spring member as well as that of the silicone rubber ring will decrease. As a result, the contact pressure may no longer be sufficient to provide for a reliable electrical contact.

From the international patent application WO 2003/044901 A1 an electrical connector is known, which comprises a tubular contact formed of a plurality of elongated contact strips mounted in a bore of a housing of the electrical connector. The contact is at one end provided with anchor means for fixedly connecting this end of the contact to a first end of the housing. These anchor means can e.g. be clamped between the housing and a tight-fitting annular collar slipped over the housing. Moreover, the other end of the contact is provided with further anchor means for fixedly connecting this other end of the contact to the housing, e.g. by means of a rivet.

The German Patent publication DE 198 36 196 C2 discloses a high-voltage electrical connector with a contact spring in its inner volume and an opening at one end of the inner volume for a complementary connector to be introduced into the electrical connector. The opening of the housing is provided with a thread into which a ring can be screwed in order to clamp a collar of the contact spring so that the contact is on one side fixed inside the housing.

SUMMARY

It is an object to provide an improved electrical connector for securely establishing an electrical contact with a complementary electrical connector, in particular in a high-temperature environment.

The problem is solved by an electrical connector for establishing an electrical contact with a complementary connector, the electrical connector comprising: a housing having an essentially cylindrical inner volume with an opening at one end; an elongated contact element disposed inside the inner volume to contact the complementary connector when the latter is introduced into the inner volume; and an elongated spring element disposed between a wall of the inner volume and the contact element to resiliently support the elongated contact element, wherein the contact element comprises a anchor section clamped between a first and a second part of the housing.

At least at one end, the inner volume has an opening. Advantageously, through the opening the contact element of the complementary connector can be introduced into the inner volume. Of course, embodiments are also imaginable, in which the inner volume is provided with on openings at both ends. The electrical connector advantageously can be an electrical socket and the complementary connector can be an electrical plug.

The invention is particularly suitable for high-temperature environments, e.g. with temperature of above 200° C., where due to the temperature the elasticity of the spring element may be compromised to such an extent that it is no longer sufficient for providing a reliable contact between the contact element and the wall of the inner volume. For example, near the combustion engine of an automobile, temperatures of around 200° C. can occur. The electrical power dissipation of cables and connectors may yield a further temperature increase by approx. 45° C. Thus, in such environments, the connector is required to securely establish an electrical contact at temperatures of close to 250° C. Other high-temperature applications occur for example in ovens, where temperatures may reach of up to 400° C.

Advantageously, the clamping of the anchor section between the two parts of the housing can due to the clamping pressure result into a cold welding of at least part of the anchor section to at least one of the housing parts. Such cold welding can provide for a particularly reliable electrical contact between the anchor section and the housing. It can also help to reduce the contact resistance between the anchor section and the housing.

Preferred features which may be applied alone or in combination are discussed in the dependent claims.

In a preferred embodiment, the elongated contact element and the elongated support element are individual parts. In other words, they are separates. In particular, the elongated contact element and the elongated support element preferably do not form a clad material, a laminate or a composite. Preferably, the elongated contact element is arranged slidably relatively to the elongated support element, more preferably slidably in the longitudinal direction and/or the circumferential direction of the contact element and the support element. It is an achievable advantage of this embodiment that unfavourable effects due to differences of the coefficients of thermal expansion of the contact element and the support element can be avoided. For example, temperature-induced bending of the kind observed in bi-metallic strips can be avoided. Such bending may, in the worst case, entail a disconnection of the contact element from its counterpart. Moreover, deterioration of the elements, in particular when the connector is (dis-) connected at high temperatures, can be countered, and the lifespan of the connector can be increased. In can be achieved that the behaviour, in particular the resilient properties, of the connector when connecting and disconnecting are less temperature dependent. Thus, a connector can be provided that can easily and securely be connected both at low and high temperatures.

The elongated support element preferably clasps around the elongated contact element. More preferably, it clasps around only those parts of the contact element that are not clamped between the first and the second part of the housing. The elongated contact element preferably is not clamped between the first and the second part of the housing.

In a preferred embodiment, the first part of the housing comprises an electrical contact, preferably a contact pin, for attaching an electrical conductor to the electrical connector. Preferably, the first part of the housing comprises an electrically conducting material in order to conduct electricity from the anchor section to the electrical contact. The electrically conducting material can e.g. be copper or a copper alloy, e.g. brass. A preferred first part of the housing is essentially made entirely of the electrically conducting material. The first part of the housing may be plated with an electrically conducting material, e.g. silver or gold. Advantageously, since in this embodiment the first part of the housing serves to conduct electricity from the contact element to the electrical contact, the second part must not necessarily be made of or plated with an electrically conducting material. Preferably, however, both parts of the housing are made of an electrically conducting material, preferably the same material. This can further improve the electrical contact with the contact element.

Preferably, unlike the contact element the spring element is not clamped between the first and the second parts of the housing. Thus, advantageously, both sides of the anchor section of the contact element can contact corresponding surfaces of the housing parts to ensure a reliable electrical contact.

In a preferred embodiment, one of the first and the second parts of the housing, preferably the second part, compromises the cylindrical inner volume or the part of the cylindrical inner volume in which the contact element and the spring element are disposed. In one embodiment, the inner volume further extends into the other part of the housing, preferably the first part. Advantageously, this extension of the inner volume can accommodate part of the length of the complementary connector when the latter is introduced into the electrical connector. Preferably, the extension of the inner volume accommodates a forward end of the complementary connector when introduced into the electrical connector.

As the elongated contact element is located inside the cylindrical inner volume, it comprises one end turned towards the opening of the cylindrical inner volume and another end turned away from the opening. Preferably, the anchor section is located on the side of the contact element turned away from the opening of the cylindrical inner volume. Thereby, advantageously, the anchor section can easily contact the first part of the housing, which is preferably placed at the end of the electrical connector opposite the opening.

Preferably, the first and the second part of the housing are joined with positive locking, preferably by means of providing them with complementary threads to clamp the anchor section between the parts by screwing them together. In the part of the housing in which the elongated contact element is disposed, preferably, the longitudinal axis of the thread coincides with the longitudinal axis of the contact element. This way, an axially symmetrical arrangement can be achieved, which facilitates clamping of the anchor section between the two parts of the housing. Alternatively, the first and the second part of the housing are joined by a non-positive, i.e. force-tied, connection. The anchor section can then be clamped between the parts by applying an external force. After releasing the external force, the entailed clamping force can to a considerable extent be maintained as a result of the force-tied connection.

Preferably, the surfaces of the first and the second parts of the housing, between which surfaces the anchor section is clamped, are at an angle to the longitudinal direction of the threads. Advantageously by tightening the screw joint, the anchor section can be securely clamped between the first and the second part of the housing. It is even possible to cold weld the anchor section with at least one part of the housing, preferably both parts, by sufficiently tightening the screw joint. The angle between the surfaces and the longitudinal axes is equal to or smaller than 90°, preferably smaller than 70°, more preferably smaller than 50°, more preferably smaller than 40° (in units based on a 360° full circle). The angle between the surfaces and the longitudinal axes is preferably larger than 5°, more preferably larger than 10°, more preferably larger than 15°, e.g. approximately 25°. With a smaller angle, a higher pressure on the anchor section at a given torque can be achieved while too low an angle may require at least one of the threads to be inconveniently long.

In a preferred embodiment, the elongated contact element comprises multiple contact lamellae extending in the longitudinal direction of the inner volume. Preferably, these lamellae are at least locally bent towards the centre of the inner volume. When the contact surface of the complementary connector is introduced into the inner volume, the lamellae can be deflected, preferably resiliently deflected, towards the wall of the inner volume and resiliently press or be pressed against the contact surface.

Preferably, the elongated contact element has an essentially tubular shape, preferably with a circular cross-section. Moreover, the preferred elongated contact element has a constriction, preferably at or near the centre of its longitudinal extension, for contacting the complementary connector when the latter is introduced into the inner volume. This constriction preferably is formed by the contact lamellae arched towards the axis of the contact element. In a preferred embodiment, the elongated contact element comprises two rings and the lamellae extend essentially parallel to each other between these rings.

The contact element can e.g. be created from a generally rectangular sheet with two transversally extending webs. Between the inner side edges of the webs, multiple slots are formed, e.g. by stamping, to define multiple parallel, longitudinally extending lamellae which are jointed at opposite ends to the inward sides of the webs. The sheet is then formed into a cylinder with the lamellae extending essentially parallel to the cylinder axis but being arched towards the cylinder axis.

Preferably, the anchor section of the contact element comprises multiple anchor tabs. These tabs preferably are attached to one of the two rings on the ring's side opposite to the lamellae. Similar to the lamellae, they can be created by forming multiple parallel slots extending from an outer side edge of one of the webs.

The anchor tabs are inclined, preferably outwardly inclined, with an angle preferably equal to or smaller than 90°, more preferably smaller than 70°, more preferably smaller than 50°, more preferably smaller than 40° with respect to the longitudinal axes of the contact element. The angle is preferably larger than 5°, more preferably larger than 10°, more preferably larger than 15°, e.g. approximately 25°. Preferably, the angle is the same as the one in which the surfaces of the first and second part of the housing are inclined, in order to facilitate clamping the anchor section between these surfaces.

The elongated spring element for supporting the contact element preferably comprises multiple resilient lamellae extending in the longitudinal direction of the inner volume. Preferably, the resilient lamellae are at least locally bend towards the centre of the inner volume in order to support the contact lamellae which are also bend towards the centre of the inner volume. As a result, when the contact lamellae are deflected by a contact surface of a complementary connector introduced into the electrical connector, they can be pressed resiliently against the contact surface by the resilient lamellae, preferably adding to the contact lamellae's own resilience, in order to provide for a good and reliable electrical contact.

Preferably, the elongated spring element has an essentially tubular shape, preferably with a circular cross-section. A constriction in the spring element preferably supports a corresponding constriction in the contact element. This constriction preferably is formed by the resilient lamellae arched towards the central axis of the spring element. The spring element preferably consists of two rings between which the resilient lamellae extend. It can be created essentially in the same way as the contact element is created from a sheet with two transversally extending webs between the inner edges of which multiple parallel slots are formed to define multiple longitudinally extending lamellae between these slots. The sheet is then formed into a cylinder with the resilient lamellae extending essentially parallel to the cylinder axes but being arched towards the cylinder axis. The spring element, however, preferably lacks the tabs of the contact element.

In a preferred embodiment, the elongated spring element is shaped such that essentially its entire inner side rests on the outer side of the elongated contact element. To achieve this, the contact element and the spring element essentially have the same shapes. In an alternative preferred embodiment, only parts of the inner side of the elongated spring element rests on parts of the outer side of the elongated contact element. Such parts may e.g. be certain pre-defined support locations, preferably in the area of the restriction of the contact element. In order to support the contact element and press it against the complementary electrical connector when the latter is introduced into the electrical connector, part of the outer side of the elongated spring element rests on the cylindrical wall of the cylindrical inner volume.

The contact element and the spring element preferably are made of different materials. In general, materials with a high electrical conductivity have a lower relaxation temperature, resulting in a reduced resilience at high temperatures. By choosing different materials for the contact element and the spring element, advantageously a high electrical conductivity and a sufficient resilience at high temperature can be achieved. Preferably, both materials are metals. The contact element preferably has a higher electrical conductivity than the spring element. The spring element preferably has a higher relaxation temperature than the contact element. In a preferred embodiment, the relaxation temperature of the material of the spring element is above 250° C., more preferably above 300° C., more preferably above 400° C., more preferably above 500° C. The relaxation temperature of the material of the contact element preferably is below 200° C., more preferably below 160° C.

In a preferred embodiment, the contact element is made of copper or a material comprising copper, e.g. a copper/tin alloy or a copper/beryllium alloy. Copper has a relaxation temperature of approximately 100° C., copper/tin alloy typically has a relaxation temperature of between 120 and 130° C., and copper/beryllium alloy typically has a relaxation temperature of between 140 and 150° C. The contact element may be plated, e.g. with gold, silver or copper. The spring element preferably is made of steel, more preferably of stainless steel. The relaxation temperature of stainless steel typically is above 500° C. Thus, even at temperature as high as 250° C. or even 400° C. high electrical conductivity and sufficient resilience can be achieved.

DETAILED DESCRIPTION

Figure 1:
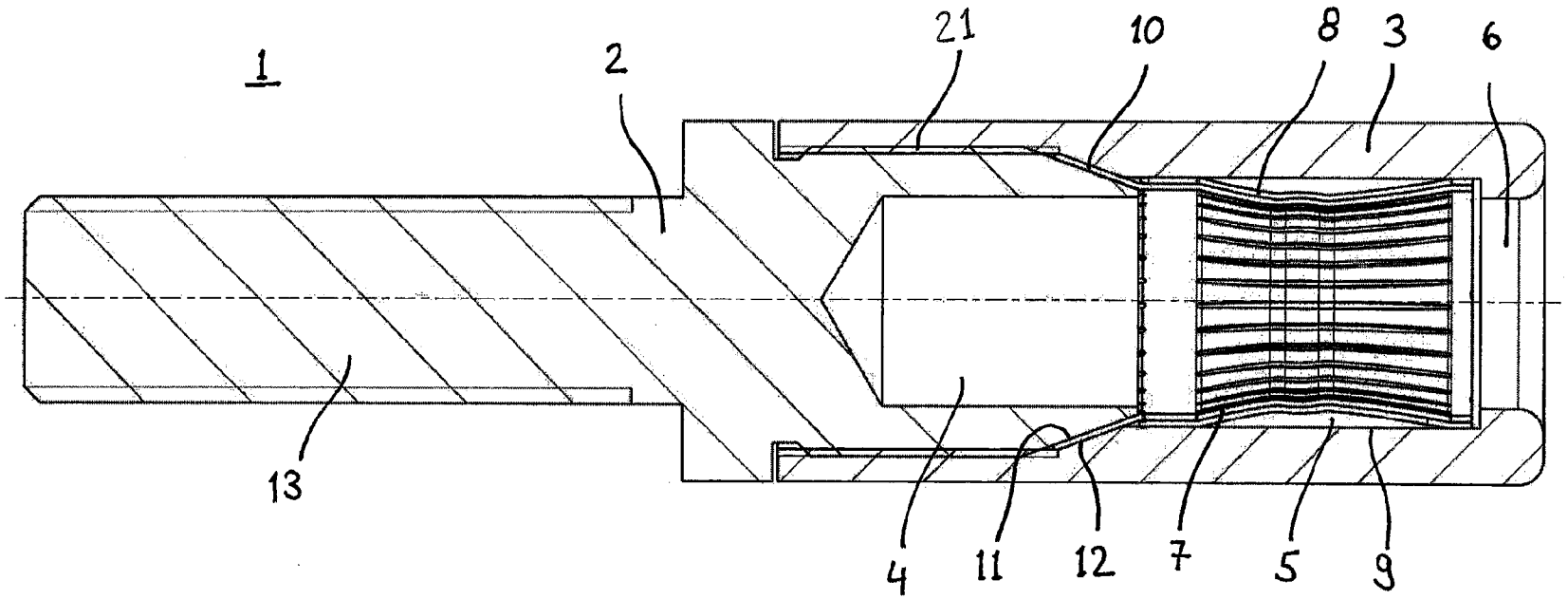
FIG. 1 is a cross-sectional view of an electrical connector according to the invention.
Figure 2:
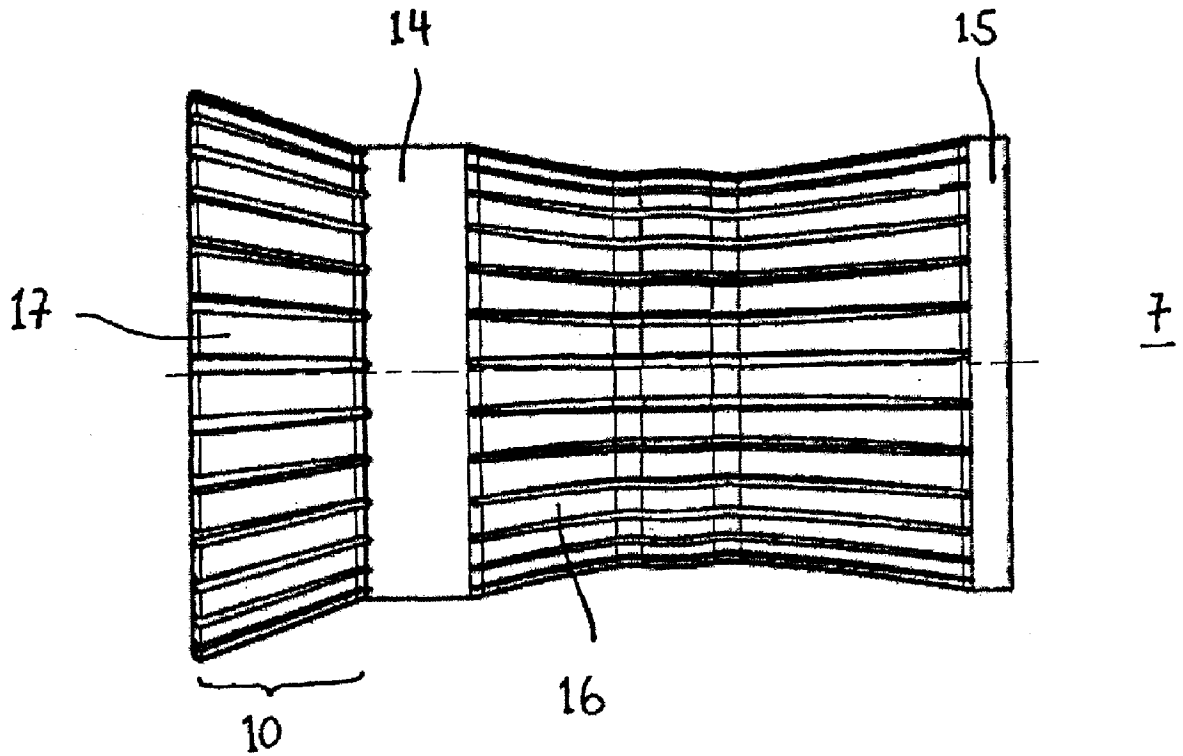
FIG. 2 is an elevation view of the elongated contact element of the electrical connector of FIG. 1.
Figure 3:
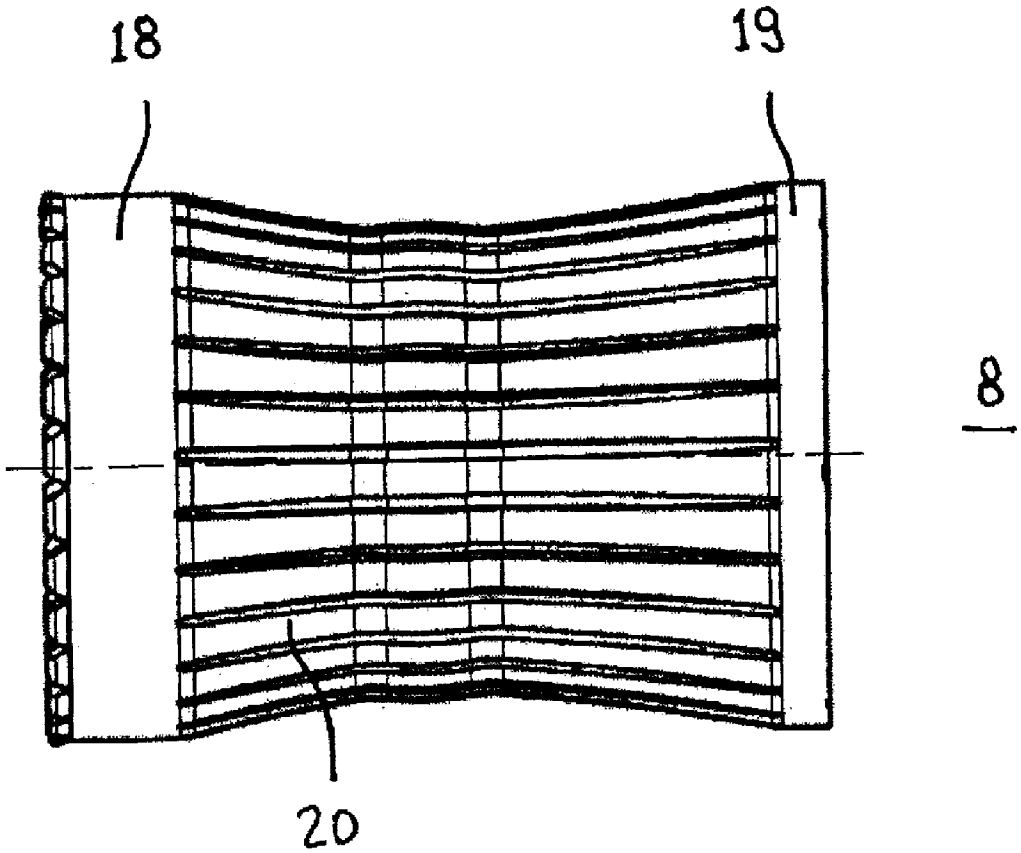
FIG. 3 is an elevation of the elongated spring element of the electrical connector according to FIG. 1.
Figure 4:
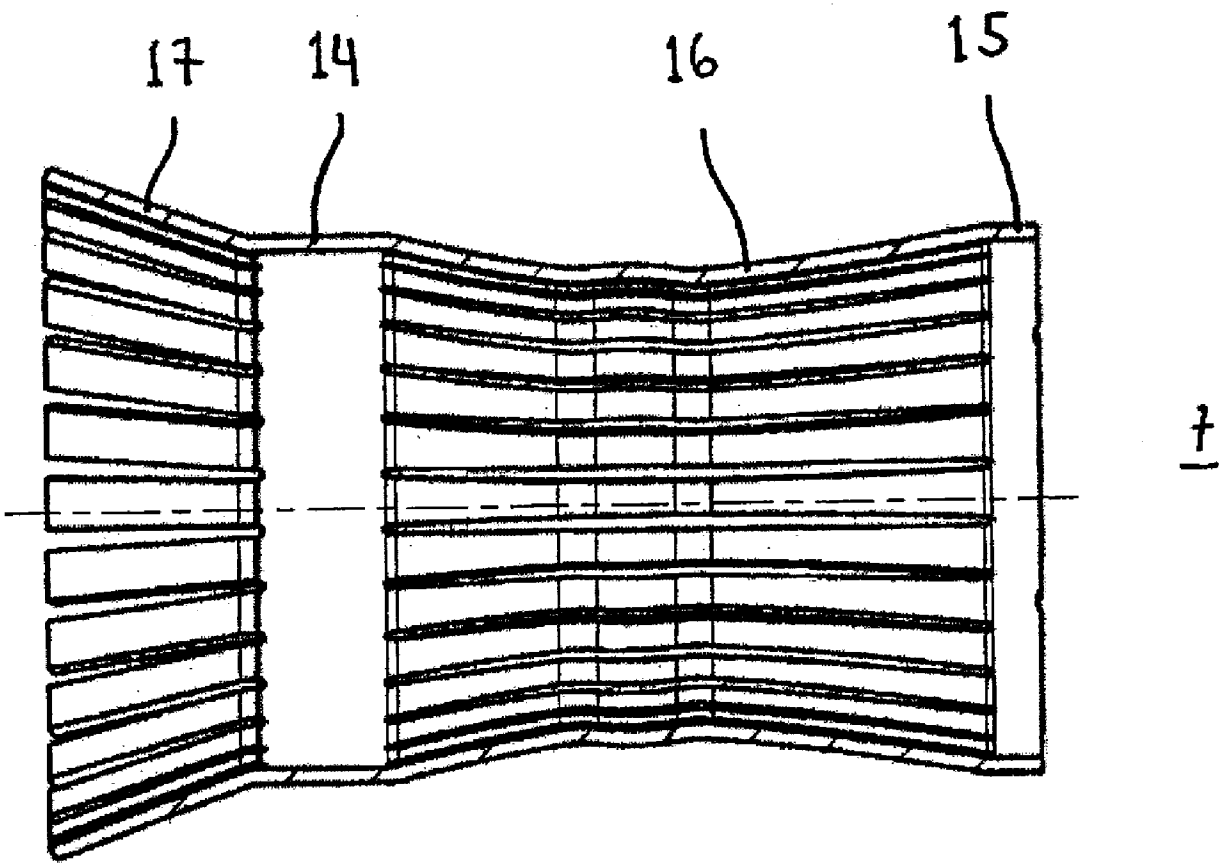
FIG. 4 is a cross-sectional view of the elongated contact element of FIG. 2.
Figure 5:
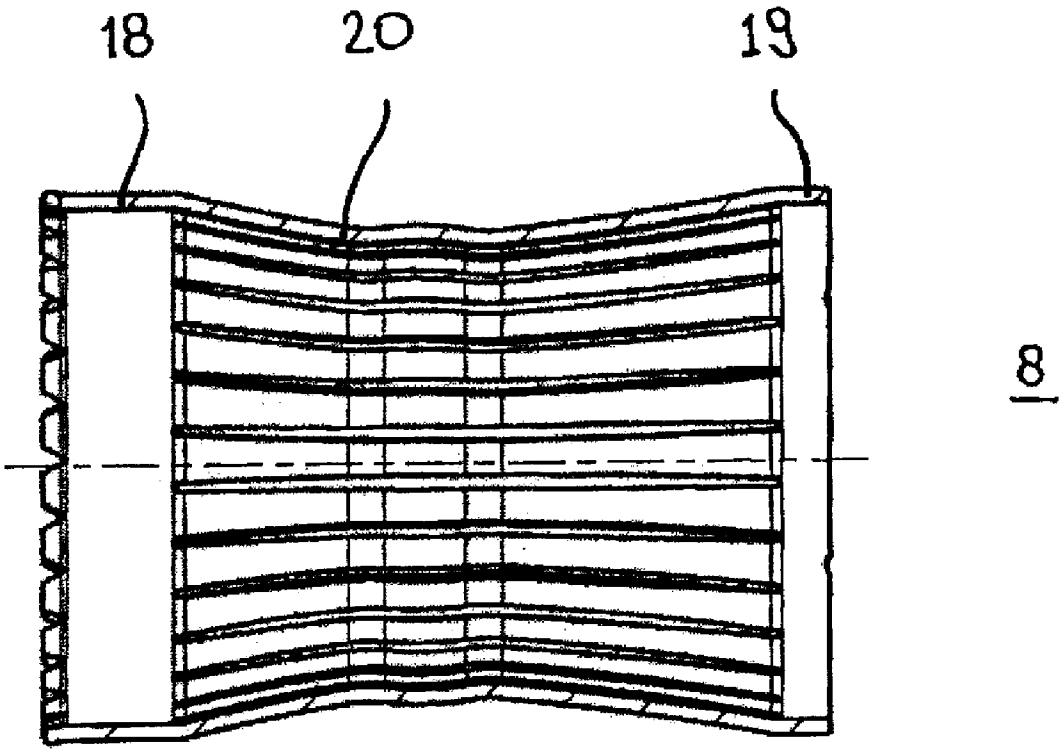
FIG. 5 is a cross-sectional view of the elongated spring element of FIG. 3.

An embodiment of an electrical connector 1 is illustrated in FIG. 1 by means of a simplified cross-sectional view. It comprises a housing with an essentially cylindrical inner volume 4, 5 with a circular cross-section and an opening 6 at one of its end. An elongated contact element 7, which will be discussed in more detail below with the aid of FIGS. 2 and 4, is disposed inside the inner volume 5 and can contact the contact surface of a complementary connector (not shown) when the latter is introduced into the electrical connector 1 through the opening 6. Moreover, an elongated spring element 8, which will be discussed in more detail below with the aid of FIGS. 3 and 5, is disposed between the wall 9 of the inner volume 3 and the contact element 7 to resiliently support the contact element and press it against the contact surface of the complementary connector.

The housing comprises a first part 2 and a second part 3 between which an anchor section 10 of the contact element 7 is clamped. For this purpose, the parts 2, 3 of the housing are provided with corresponding threads 21 to screw the first part 2 into the second part 3. The first part 2 comprises an inwardly tapered end forming a clamping surface 11 and the second part comprises an outwardly tapered section forming another clamping surface 12. The anchor section 10 is then clamped between the clamping surface 11 of the first 2 and a clamping surface 12 of the second part 3 of the housing. The surfaces are inclined with respect to the longitudinal axis of the electrical connector by an angle of approximately 25°. As a result of the clamping force, the anchor section is clod welded to the housing parts 2, 3.

The first part of the housing is provided with a contact pin 13 for attaching an electrical conductor (not shown) such as a wire to the electrical connector 1, e.g. by welding. Thus, an electrical current can flow through the first part 2 of the housing from the anchor section 10 of the contact member 7 to the electrical contact 13. The parts 2, 3 of the housing are made of copper.

The cylindrical inner volume comprises a first part 4 extending through the first part of the housing and a second part 5 extending through the second part of the housing and adjacent to the opening 6. The contact element and the spring element are disposed in the second part 5 of the inner volume. The anchor section 10 is located on the end of the contact element 7 turned away from the open end 6. The other end of the contact element 7 is not fixedly attached to the housing.

The contact element 7 is now discussed in greater detail with reference to FIGS. 2 and 4. It is essentially tubular in shape and made of a copper/beryllium alloy. The axis of the tube essentially coincides with the axis of the cylindrical inner volume 4, 5. The contact element comprises two rings 14, 15 between which multiple parallel lamellae 16 extend. The lamellae 16 are slightly arched towards the axis of the contact element so that a constriction is formed roughly half way between the rings 14, 15. It is at this constriction where the contact element 7 is meant to contact a complementary connector when the latter is introduced into the electrical connector 1. Moreover, to an outside edge of one of the rings 14 multiple anchor tabs 17 are attached to form the anchor section 10. The anchor tabs 17 are inclined away from the longitudinal axis of the contact element 7 by about 25°.

The spring element 8 shown in FIGS. 3 and 5 essentially has the same construction as the contact element 7 shown in FIGS. 2 and 4 but is made of highly resilient stainless steel. The axis of the spring element 8 essentially coincides with the axis of the cylindrical inner volume 4, 5. It also comprises two rings 18, 19 between which resilient lamellae 20 extend. The spring element 8 lacks the anchor section 10 of the contact element 7. When the spring element 8 is slipped over the contact element 7, essentially its entire inner side rests on the outer side of the contact element 7 in order to support the latter. When introduced into the electrical connector 1, the rings 18, 19 of the spring element are pressed against the wall of the cylindrical inner volume 5.

The features as described in the above description, claims and figures can be relevant to the invention in any combination.

We claim:

1. An electrical connector for establishing an electrical contact with a complementary connector, the electrical connector comprising: a housing having an essentially cylindrical inner volume with an opening at least at one end; an elongated contact element disposed inside the inner volume to contact the complementary connector when the elongated contact element is introduced into the inner volume; and an elongated spring element disposed between a wall of the inner volume and the contact element to resiliently support the elongated contact element, wherein the contact element comprises an anchor section clamped between a first and a second part of the housing.

2. The electrical connector according to claim 1, wherein the elongated contact element and the elongated spring element are individual parts.

3. The electrical connector according to claim 1, wherein the anchor section is cold welded to at least one of the first and the second part of the housing.

4. The electrical connector according to claim 1, wherein the first part of the housing comprises an electrical contact for attaching an electrical conductor to the electrical connector.

5. The electrical connector according to claim 1, wherein the anchor section is located on the side of a contact element turned away from the open end of the cylindrical inner volume.

6. The electrical connector according to claim 1, wherein the first and the second part of the housing are provided with complementary threads to clamp the anchor section between them by screwing the first and the second part together.

7. The electrical connector according to claim 6, wherein surfaces of the first and the second parts of the housing, between which surfaces the anchor section is clamped, are at an angle to a longitudinal direction of the threads.

8. The electrical connector according to claim 1, wherein the elongated contact element comprises multiple contact lamellae extending in a longitudinal direction of the inner volume.

9. The electrical connector according to claim 8, wherein the contact lamellae are at least locally bent towards a centre of the inner volume.

10. The electrical connector according to claim 1, wherein the elongated contact element has an essentially tubular shape.

11. The electrical connector according to claim 1, wherein the anchor section of the elongated contact element comprises multiple anchor tabs.

12. The electrical connector according to claim 1, wherein the elongated spring element comprises multiple resilient lamellae extending in a longitudinal direction of the inner volume.

13. The electrical connector according to claim 12, wherein the resilient lamellae are at least locally bent towards the centre of the inner volume.

14. The electrical connector according to claim 1, wherein the elongated spring element has an essentially tubular shape.

15. The electrical connector according to claim 1, wherein part of an outer side of the elongated spring element rests on the wall of the cylindrical inner volume.

* * * * *